US011549365B2

(12) United States Patent
Wu et al.

(10) Patent No.: US 11,549,365 B2
(45) Date of Patent: Jan. 10, 2023

(54) DOWNHOLE LOGGING TOOL INCORPORATING METAMATERIAL

(71) Applicant: Halliburton Energy Services, Inc., Houston, TX (US)

(72) Inventors: Hsu Hsiang Wu, Sugar Land, TX (US); Yijing Fan, Singapore (SG); Li Pan, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 110 days.

(21) Appl. No.: 17/086,904

(22) Filed: Nov. 2, 2020

(65) Prior Publication Data

US 2022/0136386 A1 May 5, 2022

(51) Int. Cl.
*H01Q 17/00* (2006.01)
*E21B 47/13* (2012.01)

(52) U.S. Cl.
CPC ..... *E21B 47/13* (2020.05); *H01Q 17/00* (2013.01); *H01Q 17/002* (2013.01); *H01Q 17/007* (2013.01); *H01Q 17/008* (2013.01)

(58) Field of Classification Search
CPC ..... H01Q 1/52; H01Q 1/521; H01Q 1/525; H01Q 17/00; H01Q 17/002; H01Q 17/007; H01Q 17/008; E21B 47/14
See application file for complete search history.

(56) References Cited

U.S. PATENT DOCUMENTS 4,814,768 A 3/1989 Chang
7,675,289 B1 * 3/2010 Stolarczyk ..... G01V 3/15 324/334
9,964,659 B2 5/2018 Fouda et al.
10,101,491 B2 10/2018 Fouda et al.
2014/0298900 A1 * 10/2014 Clarke ..... E21B 49/00 73/152.55
2017/0276822 A1 * 9/2017 Ewe ..... G01V 3/30
(Continued)

FOREIGN PATENT DOCUMENTS

WO 2016025001 A1 2/2016
WO 2016167761 A1 10/2016
(Continued)

OTHER PUBLICATIONS

Alpine et al., Wide-band negative permeability of nonlinear metamaterials, May 2012 (Year: 2012).*
(Continued)

*Primary Examiner* — Benyam Haile
(74) *Attorney, Agent, or Firm* — Conley Rose, P.C.; Rodney B. Carroll

(57) ABSTRACT

A wellbore servicing tool. The wellbore servicing tool comprises a tool body, an electromagnetic transmitter coupled to the tool body, an electromagnetic receiver coupled to the tool body and spaced apart from the electromagnetic transmitter, wherein a portion of the tool body between the electromagnetic transmitter and the electromagnetic receiver defines a direct signal path between the electromagnetic transmitter and the electromagnetic receiver, and an absorbing material coupled to the tool body in the direct signal path between the electromagnetic transmitter and the electromagnetic receiver, proximate to the electromagnetic receiver.

15 Claims, 9 Drawing Sheets

(56) References Cited

U.S. PATENT DOCUMENTS

| | | | | |
|---|---|---|---|---|
| 2017/0362925 | A1 | 12/2017 | Zhang | |
| 2019/0232555 | A1* | 8/2019 | Shaw | B29C 64/124 |
| 2019/0277995 | A1 | 9/2019 | Fouda et al. | |
| 2020/0096665 | A1 | 3/2020 | Wu et al. | |

FOREIGN PATENT DOCUMENTS

| | | | |
|---|---|---|---|
| WO | 2020060883 | A1 | 3/2020 |
| WO | 2020209867 | A1 | 10/2020 |

OTHER PUBLICATIONS

Foreign Communication from Related Application—International Search Report and Written Opinion of the International Searching Authority, International Application No. PCT/US2020/058551, dated Jul. 28, 2021, 12 pages.

* cited by examiner

DOWNHOLE LOGGING TOOL INCORPORATING METAMATERIAL

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Downhole logging tools provide measurements of properties of subterranean formations that may provide useful insight into the structure of the subterranean geology. Understanding the subterranean structure can assist in directional drilling and in determining the probability that a given formation contains hydrocarbons. For example, it may be desirable to directionally drill parallel to but offset about 10 feet or some other predefined distance from the interface between two distinct subterranean formations or structures. Because this interface may vary at different places (e.g., the surface of this interface may undulate), it may be a challenge to maintain this desired distance offset. By using downhole logging tools, the distance from the downhole logging tool to the interface between the two distinct formations may be determined with sufficient precision to accomplish the drilling goals.

A variety of different physical signals can be used to sense the properties of a subterranean formation. One physical signal is an electromagnetic wave emitted from an electromagnetic transmitter coupled to the downhole tool and received by an electromagnetic receiver coupled to the downhole tool. Where the electromagnetic wave propagating in the subterranean environment encounters a change in electrical properties of the formation, some of the electromagnetic wave may reflect off the interface where the electrical properties change. From receiving and subsequently analyzing the reflected electromagnetic signals, inferences can be made about the structure of the subterranean formations, and those inferences can be applied in steering a drill bit (e.g., in directional drilling, possibly following a substantially horizontal trajectory) or for other purposes such as estimating the likelihood that a hydrocarbon bearing formation is present.

SUMMARY

In an embodiment, a wellbore servicing tool is disclosed. The wellbore servicing tool comprises a tool body, an electromagnetic transmitter coupled to the tool body, an electromagnetic receiver coupled to the tool body and spaced apart from the electromagnetic transmitter, wherein a portion of the tool body between the electromagnetic transmitter and the electromagnetic receiver defines a direct signal path between the electromagnetic transmitter and the electromagnetic receiver, and absorbing material coupled to the tool body along the direct signal path between the electromagnetic transmitter and the electromagnetic receiver, proximate to the electromagnetic receiver.

In another embodiment, a method of absorbing a direct signal between an electromagnetic transmitter and an electromagnetic receiver of a wellbore servicing tool is disclosed. The method comprises coupling a material to a tool body of the wellbore servicing tool proximate to the electromagnetic receiver and in a direct signal path defined by the tool body between the electromagnetic transmitter and the electromagnetic receiver, transporting the wellbore servicing tool to a wellbore, deploying the wellbore servicing tool into the wellbore, transmitting an electromagnetic signal by the electromagnetic transmitter, and absorbing at least in part the electromagnetic signal transmitted by the electromagnetic transmitter by the material in the direct signal path between the electromagnetic transmitter and the electromagnetic receiver.

In yet another embodiment, a method of sensing properties of a subterranean formation proximate to a wellbore is disclosed. The method comprises deploying a wellbore servicing tool into a wellbore, wherein the wellbore servicing tool comprises an electromagnetic transmitter coupled to a tool body of the wellbore servicing tool, an electromagnetic receiver coupled to the tool body, and absorbing material coupled to the tool body between the electromagnetic transmitter and the electromagnetic receiver and proximate to the electromagnetic receiver in a direct signal path defined by the tool body between the electromagnetic transmitter and the electromagnetic receiver. The method further comprises transmitting a signal by the electromagnetic transmitter, absorbing at least some of the electromagnetic signal by the absorbing material in the direct signal path, receiving the electromagnetic signal via a reflected signal path defined between the electromagnetic transmitter and the subterranean formation and from the subterranean formation to the electromagnetic receiver, and analyzing the electromagnetic signal received by the electromagnetic receiver to sense properties of the subterranean formation.

In still another embodiment, a method of enhancing sensitivity of an electromagnetic receiver of a wellbore servicing tool is disclosed. The method comprises coupling a signal reception enhancing material proximate to an electromagnetic receiver of a wellbore servicing tool, transporting the wellbore servicing tool to a wellbore, deploying the wellbore servicing tool into the wellbore, transmitting an electromagnetic signal by a transmitter of the wellbore servicing tool, inducing an electromagnetic field into surrounding formations, and enhancing by the signal reception enhancing material the induced electromagnetic signal from the formation into the electromagnetic receiver.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1A:
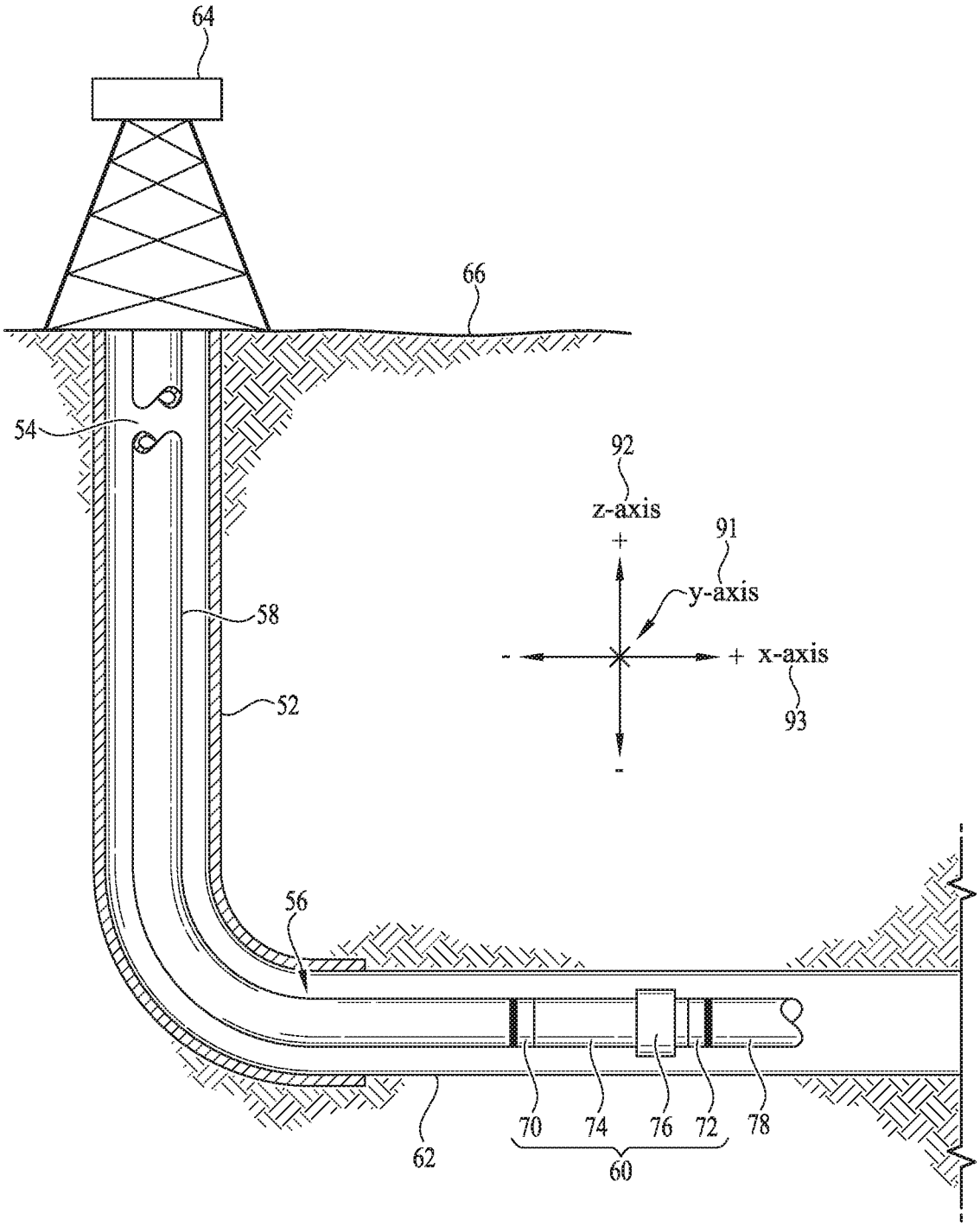
FIG. 1A is an illustration of a wellbore and wellbore servicing tool according to an embodiment of the disclosure.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Properties of subterranean formations or subterranean layers proximate to a wellbore may be determined by emitting electromagnetic signals by an electromagnetic transmitter of a well logging tool, receiving the electromagnetic signals reflected off of one or more interfaces between distinct different subterranean formations or different subterranean layers by an electromagnetic receiver of the well logging tool, and analyzing the received electromagnetic signals to determine the properties of the subterranean formations or subterranean layers. It is desirable to be able to sense formation or layer structures that are further away from the well logging tool, deeper into the formations, but the ability of the receiver to receive the weaker reflection signals from deeper within the formations or layers is limited by the signal that travels in a direct signal path from the transmitter to the receiver. The direct path signal presents as noise or interference that limits the sensitivity of the well logging tool.

The present disclosure teaches manufacturing or assembling the well logging tool with absorbing material coupled to an outside of a tool body of the well logging tool between the transmitter and the receiver and proximate to the receiver. This location of the absorbing material places it in the direct signal path between the transmitter and the receiver, allowing the absorbing material to absorb or attenuate the strength of the signal propagating in the direct path, thereby effectively increasing the sensitivity of the receiver and allowing structure to be sensed deeper into the formations. In an embodiment, this direct signal path signal can be effectively absorbed or attenuated if the absorbing material exhibits a negative electro-magnetic index. A negative electro-magnetic index may be exhibited by the absorbing material (1) when the absorbing material exhibits an effective electric permittivity of less than zero and an effective magnetic permeability of greater than zero, (2) when the absorbing material exhibits an effective electric permittivity of greater than zero and an effective magnetic permeability of less than zero, or (3) when the absorbing material exhibits an effective electric permittivity of less than zero and an effective magnetic permeability of less than zero. In an embodiment, the absorbing material comprises material having a positive effective electric permittivity and a negative effective magnetic permeability. In an embodiment, the absorbing material comprises metamaterial that exhibits a negative electro-magnetic index. In an embodiment, the absorbing material comprises metamaterial having a positive effective electric permittivity and a negative effective magnetic permeability. Metamaterials are discussed further hereinafter.

The present disclosure also teaches manufacturing or assembling the well logging tool with signal reception enhancement material coupled to the outside of the well logging tool proximate to the receiver. In an embodiment, the signal reception enhancement material is located between the receiver and the absorbing material. In another embodiment, the signal reception enhancement material is located proximate to the receiver on the side of the receiver opposite the transmitter (e.g., the receiver is located between the signal reception enhancement material and the absorbing material). In yet another embodiment, signal reception enhancement material is located on both sides of the receiver, with the absorbing material located between all the signal reception enhancement material and the transmitter. In an embodiment, signal reception enhancement material is coupled to the well logging tool and no absorbing material is coupled to the well logging tool (e.g., in this embodiment, the well logging tool employs signal reception enhancement material and does not employ absorbing material). The signal reception enhancement material is provided to enhance reception of a signal induced in the subterranean formations or subterranean layers, thereby enhancing the signal received by the receiver of the well logging tool. In an embodiment, the signal reception enhancement material comprises material having a negative electro-magnetic index. In an embodiment, the signal reception enhancement material comprises material having a positive effective electric permittivity and a negative effective magnetic permeability.

As used herein, orientation terms "upstream," "downstream," "up," "down," "uphole," and "downhole" are defined relative to the direction of flow of well fluid in the well casing. "Upstream" is directed counter to the direction of flow of well fluid, towards the source of well fluid (e.g., towards perforations in well casing through which hydrocarbons flow out of a subterranean formation and into the casing). "Downstream" is directed in the direction of flow of well fluid, away from the source of well fluid. "Down" is directed counter to the direction of flow of well fluid, towards the source of well fluid. "Up" is directed in the direction of flow of well fluid, away from the source of well fluid. "Downhole" is directed counter to the direction of flow of well fluid, towards the source of well fluid. "Uphole" is directed in the direction of flow of well fluid, away from the source of well fluid. As used herein, radial movement or direction refers to movement or direction that is perpendicular to (i.e., making a 90 degree angle with) the central axis of a downhole tool, such as a logging tool, at the associated location in the downhole tool. As used herein, transversely displaced refers to displacement along a central axis of a downhole tool, for example displacement or translation upwards substantially parallel to the central axis of the downhole tool or displacement or translation downwards substantially parallel to the central axis of the downhole tool.

Turning now to FIG. 1A, a well location is described. A wellbore 54 may be drilled into the ground and into subterranean formations or subterranean layers. A portion of the wellbore 54 may have casing 52 installed but a portion of the wellbore 54 may be uncased 62 or open hole. A tubing 58 may be placed in the wellbore 54 to support one or more wellbore servicing tools, for example a logging tool 60. In an embodiment there may be a tool string 78 that extends below the logging tool 60 or above the logging tool 60. The tubing 58 may be a series of pipe joints threaded or otherwise coupled together. The tubing 58 may be coiled tubing. In an embodiment, rather than tubing 58 the logging tool 60 may be supported by a cable. The tubing 58 or cable may be supported at least in part by a mast 64 located over the wellbore 54.

A directional reference is provided in FIG. 1A including an X-axis 93 where positive displacements along the X-axis 93 are directed rightwards and negative displacements along the X-axis 93 are directed leftwards, a Y-axis 91 where positive displacements along the Y-axis 92 are directed into the sheet and negative displacements along the Y-axis 91 are directed out of the sheet, and a Z-axis 92 where positive displacements along the Z-axis are directed upwards and negative displacements along the Z-axis 92 are directed downwards. The logging tool 60 is shown in FIG. 1 to be in a substantially horizontal portion of the wellbore 54 but the teachings of the present disclosure are applicable to wellbores 54 with other orientations, for example wellbores 54 that are substantially vertical or wellbores 54 that are disposed in some orientation between horizontal and vertical.

In an embodiment, the logging tool 60 comprises an electromagnetic transmitter 70, an electromagnetic receiver 72, a tool body 74, and absorbing material 76 coupled to the tool body 74. The absorbing material 76 may be located wholly external to the tool body 74. Alternatively, the absorbing material 76 may be located both external to the tool body 74 and internal to the tool body 74. In an embodiment, the absorbing material 76 may be at least partially disposed within grooves or slots defined by the tool body 74 as well on the outside of the tool body 74. The absorbing material 76 may be secured to an outside of the tool body 74 with an adhesive. The absorbing material 76 may be secured to the outside of the tool body 74 with attachment hardware and/or with a friction fit.

In an embodiment, the absorbing material 76 may be retained within a protective sheath or housing to avoid damage to the absorbing material 76 from contact with the casing 52 or the open hole 62. In an embodiment, the absorbing material 76 may be coated with a protective layer of plastic, of polymer, or of other material. In an embodiment, the logging tool 60 may feature centralizers disposed proximate to the absorbing material 76 that maintain the logging tool 60 in about a center of the wellbore and keeps the absorbing material 76 from colliding with the casing 52 or the open hole 62.

The logging tool 60 may communicate to equipment located at a surface 66 proximate to the wellbore 54, for example to a control station and/or a drilling control station. The logging tool 60 may communicate to equipment located at the surface 66 via wireless communication link, via wired communication link, or via fiber optic communication link. The information provided by the logging tool 60 may be employed to support drilling operations, for example a "logging while drilling" operation. The information provided by the logging tool 60 may be employed to evaluate the proximity of the open hole 62 to a hydrocarbon bearing subterranean formation.

Figure 1B:
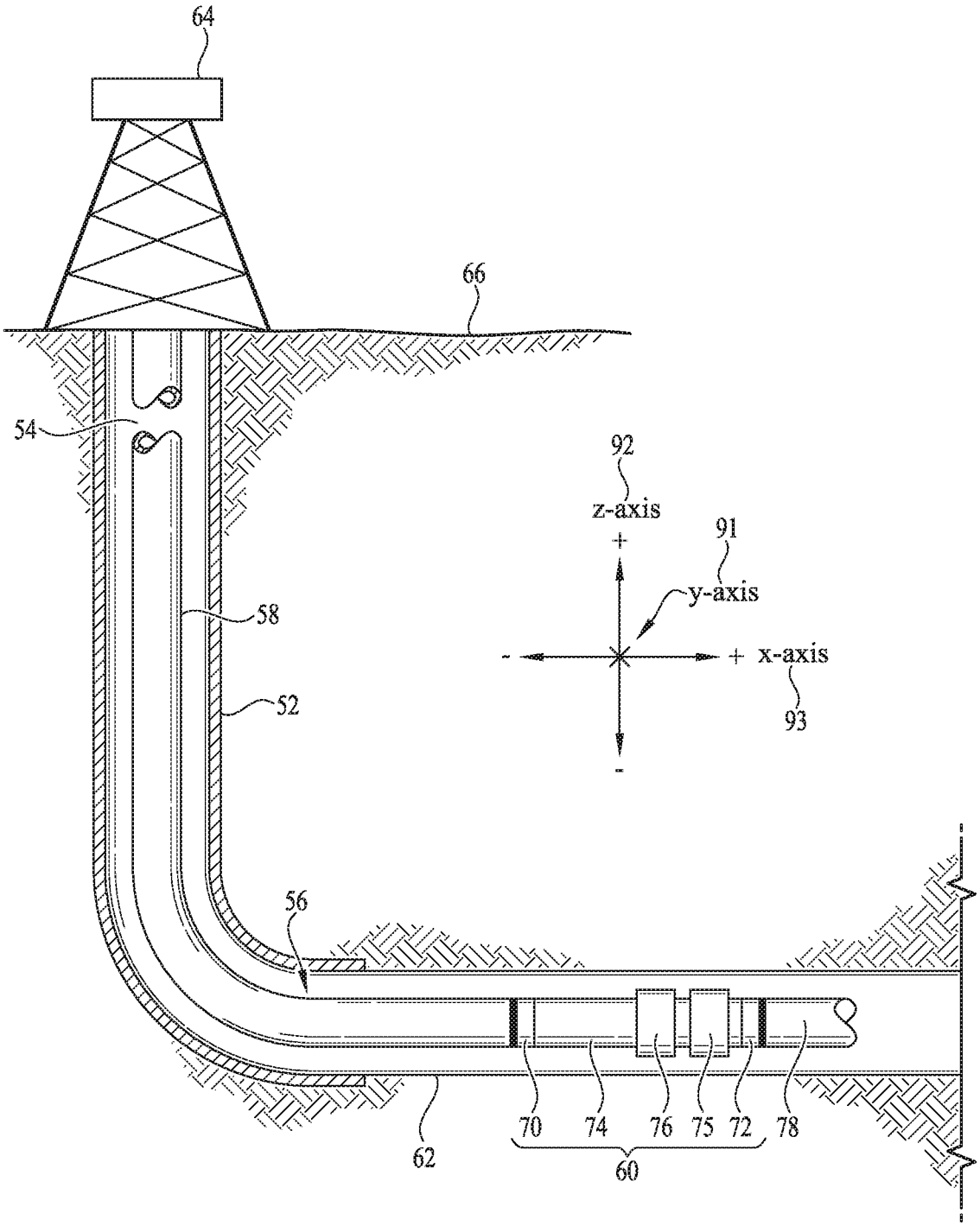
FIG. 1B is an illustration of a wellbore and another wellbore servicing tool according to an embodiment of the disclosure.

Turning now to FIG. 1B, an alternative configuration of the logging tool 60 is described. In FIG. 1B, the logging tool 60 comprises the components described above with reference to FIG. 1A but additionally comprises a signal reception enhancing material 75 coupled to the outside of the tool body 74 proximate to the receiver 70, located between the absorbing material 76 and the receiver 70. In an embodiment, the absorbing material 76 is a first metamaterial and the signal reception enhancing material 75 is made of a second metamaterial that is different from the first metamaterial. In an embodiment, the metamaterial 75 may be retained within a protective sheath or housing to avoid damage to the signal reception enhancing material 75 from contact with the casing 52 or the open hole 62. In an embodiment, the signal reception enhancing material 75 may be coated with a protective layer of plastic, of polymer, or of other material. In an embodiment, the logging tool 60 may feature centralizers disposed proximate to the signal reception enhancing material 75 that maintain the logging tool 60 in about a center of the wellbore and keeps the signal reception enhancing material 75 from colliding with the casing 52 or the open hole 62.

The signal reception enhancing material 75 may promote enhanced reception by the receiver 72 of the induced signal propagating from the subterranean formations to the receiver 72. Not wishing to be bound by theory, this enhanced reception prompted by the signal reception enhancing material 75 may be abstracted to effectively increase the signal to noise ratio (SNR) of the logging tool 60 at a system level of analysis. Alternatively, not wishing to be bound by theory, this enhanced reception prompted by the signal reception enhancing material 75 may be abstracted to effectively increase the signal strength received by the receiver 72. Alternatively, not wishing to be bound by theory, this enhanced reception prompted by the signal reception enhancing material 75 may be abstracted to effectively increase the sensitivity of the receiver 72.

Figure 1C:
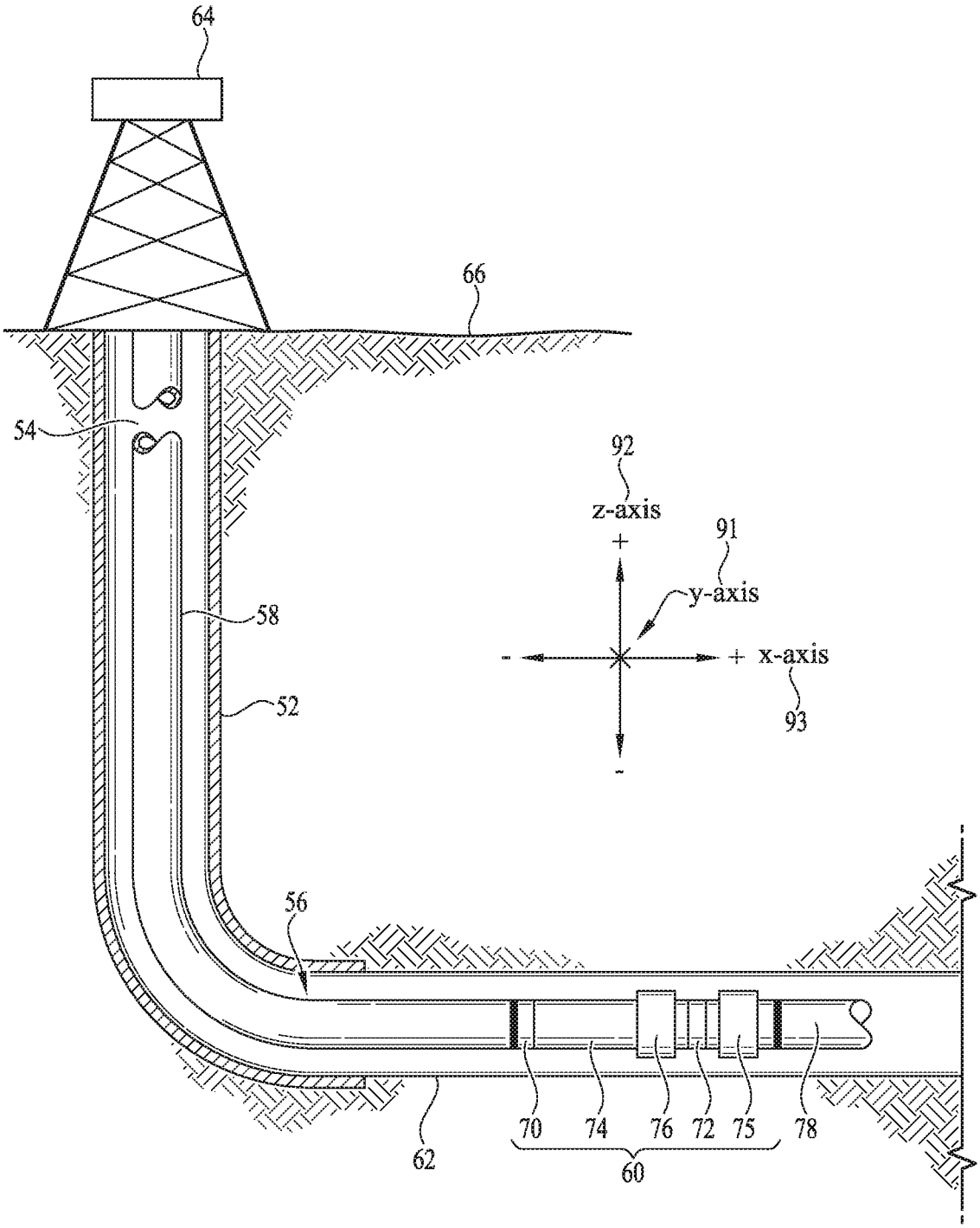
FIG. 1C is an illustration of a wellbore and yet another wellbore servicing tool according to an embodiment of the disclosure.

Turning now to FIG. 1C, an alternative configuration of the logging tool 60 is described. The embodiment, of FIG. 1C is substantially similar to the embodiment of FIG. 1B but with the signal reception enhancing material 75 located between the receiver 72 and the tool string 78 downhole of the logging tool 60 and with the absorbing material 76 located proximate to the receiver 72 between the receiver and the transmitter 70.

Figure 1D:
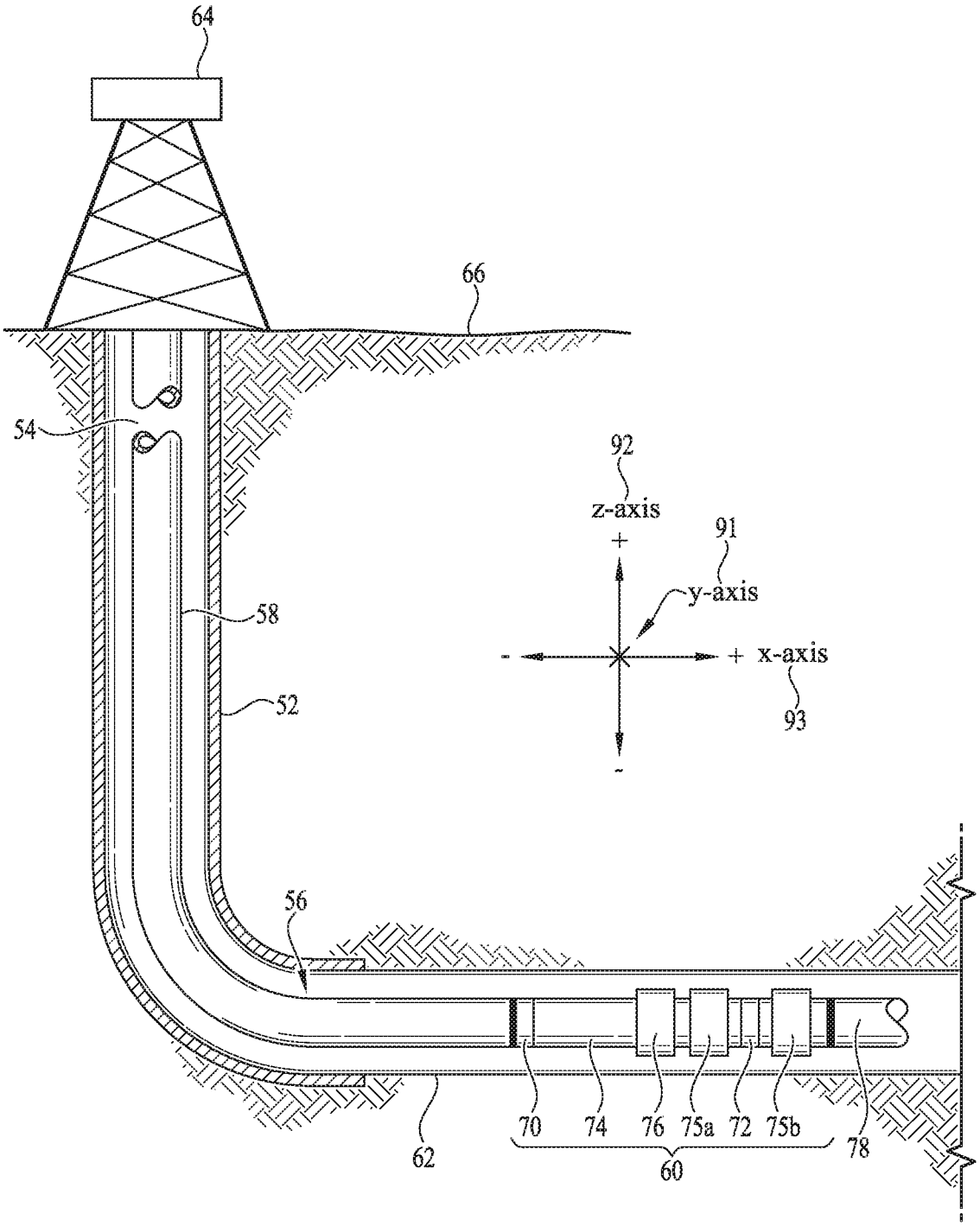
FIG. 1D is an illustration of a wellbore and still another wellbore servicing tool according to an embodiment of the disclosure.

Turning now to FIG. 1D, an alternative configuration of the logging tool 60 is described. The embodiment of FIG. 1D is substantially the combination of the embodiments of FIG. 1B and FIG. 1C: a first signal enhancing material 75*a* is coupled to the tool body 74 between the absorbing material 76 and the receiver 72, and a second signal enhancing material 75*b* is coupled to the tool body 74 between the receiver 72 and the tool string 78 downhole of the logging tool 60.

In an embodiment, the embodiment of FIG. 1B, FIG. 1C, or FIG. 1D is modified to omit the absorbing material 76 and enjoys the benefits provided by the signal reception enhancing material 75 but does not obtain the benefits of the absorbing material 76. There may be some operating environments in which it is desirable to forego the benefit of the absorbing material 76 and use only the signal reception enhancing material 75.

Figure 2:
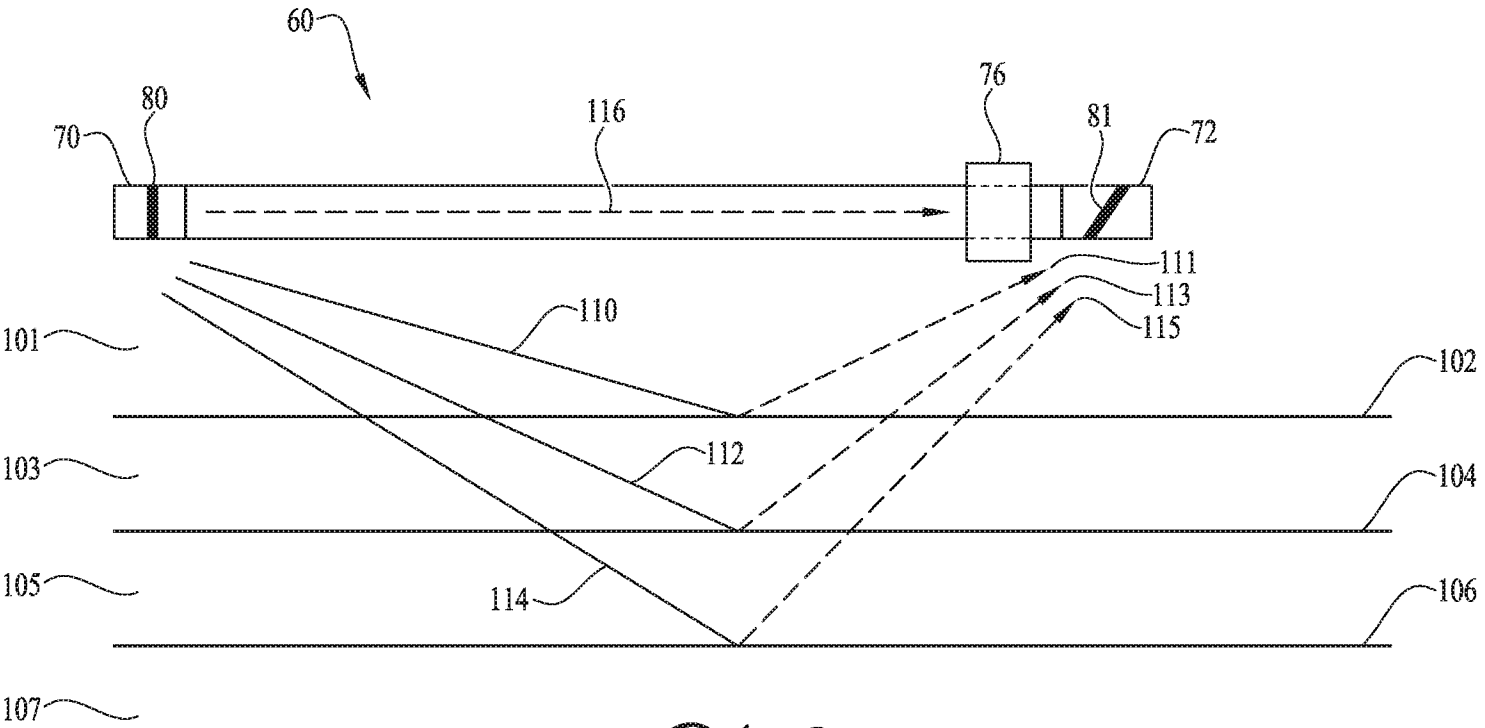
FIG. 2 is an illustration of electromagnetic signal propagation in a subterranean environment according to an embodiment of the disclosure.

Turning now to FIG. 2, transmitting and receiving by the logging tool 60 is described in a simplified form. A transmitting antenna 80 of the transmitter 70 emits an electromagnetic signal that may be considered to propagate along paths 110, 112, 114, 116. It is understood that the signal emitted by the transmitting antenna 80 may flow along many other propagation paths at the same time in addition to paths 110, 112, 114, 116. The path 116 may be referred to as a direct signal path. The path 116 may be defined, at least in part, by an outside of the tool body 74 of the logging tool 60.

The signal emitted by the transmitter 70 may be restricted to a narrow frequency band, for example restricted to 1 MHz+1-1 kHz. The signal emitted by the transmitter 70 may be emitted in pulses followed by silence. For example the signal may be emitted with a duty cycle of about 50%, about 40%, about 30%, about 25%, about 20%, about 15%, about 10%, about 8%, about 5%, or some other fractional duty cycle. The signal emitted by the transmitter 70 may be swept through a range of frequencies—either transmitting continuously or emitting with a fractional duty cycle. In an embodiment, the transmitter 70 may transmit the signal in the frequency range 1 kHz to 2 GHz. In an embodiment, the transmitter 70 may transmit the signal in the frequency range 10 kHz to 100 MHz. In an embodiment, the transmitter 70 may transmit the signal in the frequency range 100 kHz to 10 MHz. In an embodiment, the transmitter 70 may transmit the signal in the frequency range of about 200 kHz to about 2 MHz. In another embodiment, the transmitter 70 may transmit the signal in a different frequency range.

A portion of the signal emitted by the transmitting antenna 80 may propagate along path 110, a portion of the signal propagating along path 110 may be transmitted through an interface 102 between subterranean layers 101, 103, and a portion of the signal propagating along path 110 may be reflected at the interface 102 and propagate along path 111 to a receiving antenna 81 of the receiver 72. A portion of the signal emitted by the transmitting antenna 80 may propagate along path 112, a portion of the signal propagating along path 112 may be transmitted through an interface 104 between subterranean layers 103, 105, and a portion of the signal propagating along path 112 may be reflected at the interface 104 and propagate along path 113 to the receiving antenna 81 of the receiver 72. A portion of the signal emitted by the transmitting antenna 80 may propagate along path 114, a portion of the signal propagating along path 114 may be transmitted through an interface 106 between subterranean layers 105, 107, and a portion of the signal propagating along path 114 may be reflected at the interface 106 and propagate along path 115 to the receiving antenna 81 of the receiver 72. A portion of the signal emitted by the transmitting antenna 80 may propagate along path 116 (the direct signal path) to the receiving antenna 81 of the receiver 72.

The signals propagating along paths 111, 113, 115 may be considered to carry information relevant to analyzing the subterranean structures. For example, a time of arrival of signals at the receiving antenna 81 and a signal strength of the signals at the receiving antenna 81 may be analyzed to infer properties of the subterranean layers 101, 103, 104, 107 and to infer distances from the logging tool 60 to the interfaces 102, 104, 106. By contrast, the signal propagating along path 116 may best be considered as signal noise and to limit the sensitivity of the receiver 72 to receive the signals propagating along paths 111, 113, 115. Said in other words, without wishing to be limited by theory, the amplitude of the signal propagating along the direct path 116 received by the receiving antenna 81 effectively defines a signal to noise ratio (SNR) of the receiver 72. The present disclosure teaches locating absorbing material 76 proximate to the receiver 72 so as to attenuate the signal propagating in the path 116, thereby improving the effective SNR of the receiver 72 and increasing the overall sensitivity of the logging tool 60. This increased overall sensitivity of the logging tool 60 can promote the logging tool 60 sensing properties of and structure in the formations further away from the logging tool 60 (e.g., to "see" more deeply into the formations). Alternatively, this increased overall sensitivity may allow the distance between the transmitter 70 and the receiver 72 to be reduced, thereby allowing the logging tool 60 to be made shorter in length. A logging tool 60 with a shorter length may have advantages in wellbores 54 having dog legs (sharply radiused bends).

Figure 3:
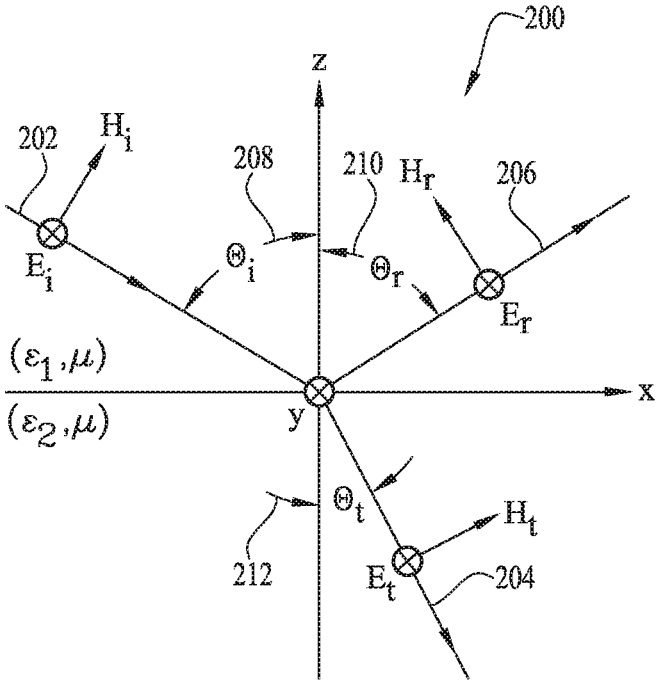
FIG. 3 is an illustration of an electromagnetic signal incident on an interface, a portion of the signal reflected off the interface, and a portion of the signal transmitted through the interface according to an embodiment of the disclosure.

Turning now to FIG. 3, a model 200 of electromagnetic waves interacting with an interface is described. Without wishing to be limited by theory, the behavior of the logging tool 60 can be theoretically modeled as below. A model can assume a spacing of 10 foot between the transmitter 70 and the receiver 72. The model can assume a distance between the logging tool 60 and the interface 101 of about 5 feet. The model can assume the layer 101 exhibits a resistance of 10 Ω·m and the layer 103 exhibits a resistance of 1 Ω·m. An overall sensitivity factor S of the logging tool 60 can be calculated as

EQ 1

$$S \equiv \frac{|VR \times (10\Omega \cdot m) - VR \times (10\Omega \cdot m \,\&\, 1\Omega \cdot m)|}{|VR \times (10\Omega \cdot m)|} \times 100(\%)$$

where VRx(10 Ω·m) is the receiver signal (typically a complex voltage measurement) when only the formation model of 10 Ω·m is presented and VRx(10 Ω·m & 1 Ω·m) is the receiver signal when a two-layer model is presented (FIG. 3). This S helps to evaluate the induced signal from the formation into the receiver measurement. The sensitivity S can be evaluated with and without the presence of a specific absorbing material 76: a metamaterial. Metamaterials are described in more detail hereinafter. The results are provided in Table 1.

TABLE 1

| Metamaterial | Electrical properties at 100 kHz | S at 50 kHz | S at 100 kHz | S at 2 MHz |
|---|---|---|---|---|
| None | εr = 1; μr = 1 | 8.72988% | 13.6232% | 30.9281% |
| −1 < μ < 0 | εr = 1; μr = −0.43 | 4.33463% | 66.0833% | 31.9913% |

When there is no metamaterial in the path 116 (e.g., no absorbing material 76) described above, the direct signal propagating along path 116 is coupled from the transmitter antenna 80 to the receiver antenna 81, and this coupling competes with the induced signal from the formation (signal propagating on path 111). This is associated with low sensitivity at 50 kHz, low sensitivity at 100 kHz, and modest sensitivity at 2 MHz. With the metamaterial in the path 116 (e.g., absorbing material 76 in place), low sensitivity is seen at 50 kHz, high sensitivity at 100 kHz, and modest sensitivity at 2 MHz. Note that the sensitivity at 100 kHz with metamaterial present produces a sensitivity double the sensitivity of the best modeling result without metamaterial present.

Electrical properties of a natural media refer to electrical conductivity (i.e., inverse of resistivity), relative permittivity (ε), and relative permeability (μ). Generally speaking, the ε and μ are typically larger than 1. When an electromagnetic (EM) signal travels from one media into another media with different electrical properties, there will be a reflection signal from the interface between the two media. As shown in FIG. 3, an incident EM wave (Hi, Ei) 202 travels from a first media (with ε1 and μ) into a second media (with ε2 and μ), resulting in a transmission wave (Ht, Et) 204 and a reflection wave (Hr, Er) 206. The angle of incidence 208 typically equals the angle of reflection 210. The angle of transmission 212 is determined as a function of the angle of incidence 208 and the relationship between the electrical properties of the two media.

An array of thin metal rods or metal wires may be arranged in a cubical lattice to form a metamaterial that exhibits a negative effective permittivity responses at the microwave regime given by the Drude function:

EQ2

$$\varepsilon(\omega) = 1 - \frac{\omega_p^2}{\omega(\omega + j\tau)} \tag{1}$$

where τ is the energy dissipation factor of the plasmon into the system (i.e., damping factor) and $\omega_p$ represents the plasma frequency. If losses are neglected (i.e., τ≈0), Eq. 2 shows that EM waves below the plasma frequency ($\omega<\omega_p$) cannot propagate since ε is smaller than 0 (μ herein >0) and the refractive index, n, will be imaginary and a wave in such medium will be evanescent. This creates a negative electromagnetic index metamaterial that is a material engineered to have a property not found in naturally occurring materials. A material with a negative electro-magnetic index has (1) effective electric permittivity less than 0.0 (ε<0.0), (2) effective magnetic permeability less than 0.0 (μ<0.0), or (3) both effective electric permittivity and effective magnetic permeability less than 0.0 (ε<0.0 and μ<0.0).

In an embodiment, the absorbing material is made of metamaterial with an effective magnetic permeability less than 1 and greater than −1, for example −1<μ<1 at a frequency of interest, for example in the frequency range of the logging tool 60 described above with reference to FIG. 2. In an embodiment, the absorbing material has an effective electric permittivity greater than 0 and an effective magnetic permeability less than 1.0 at a frequency of interest. In an embodiment, the absorbing material has an effective electric permittivity greater than 0.0 and an effective magnetic permeability greater than 0.0 at a frequency of interest. In an embodiment, the absorbing material has an effective electric permittivity greater than 0.0 and an effective magnetic permeability greater than 0.0 and less than 1.0 at a frequency of interest. In an embodiment, the absorbing material has an effective electric permittivity of greater than 0.0 and an effective magnetic permeability less than 0.0 at a frequency of interest. In an embodiment, the absorbing material has an effective electric permittivity greater than 0.0 and an effective magnetic permeability greater than −1.0 and less than 0.0 at a frequency of interest.

Materials having the values of electric permittivity and/or the magnetic permeability desired to absorb or attenuate the direct signal in the path 116 may not exist in nature. Metamaterials, however, may provide effective values of electric permittivity and/or of magnetic permeability that may not exist in nature. Metamaterials may be engineered composites that inherit their electrical and magnetic properties from the geometry and arrangement of their constituting unit cells. In an embodiment, the unit cell of the contemplated metamaterials may be much smaller than the relevant wavelengths.

Figure 4:
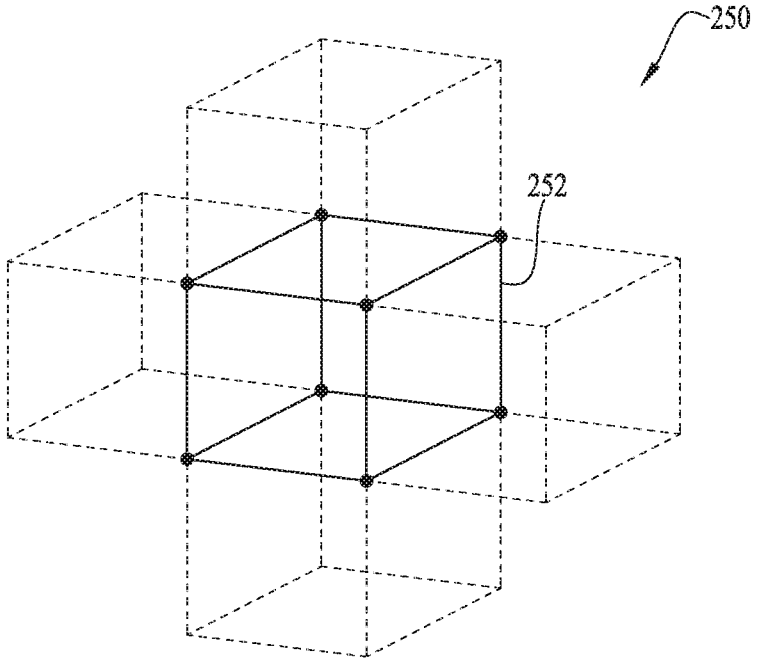
FIG. 4 is an illustration of a structure of a metamaterial according to an embodiment of the disclosure.

Turning now to FIG. 4, a metamaterial suitable for implementing a metamaterial suitable for use as the absorbing material 76 is described. The metamaterial 250 may be formed as a continuous fabric of metal wires or metal rods interconnected with each other and arranged in a cubical lattice based on the exemplary unit cell 252. The length of the wires (e.g., the sides of the unit cell 252) may be scaled to be much smaller than the wavelength of a frequency of interest for operating the logging tool 60. It is understood, however, that other metamaterials are feasible and may be used for implementing the absorbing material 76 or implementing the signal reception enhancing material 75.

Figure 5:
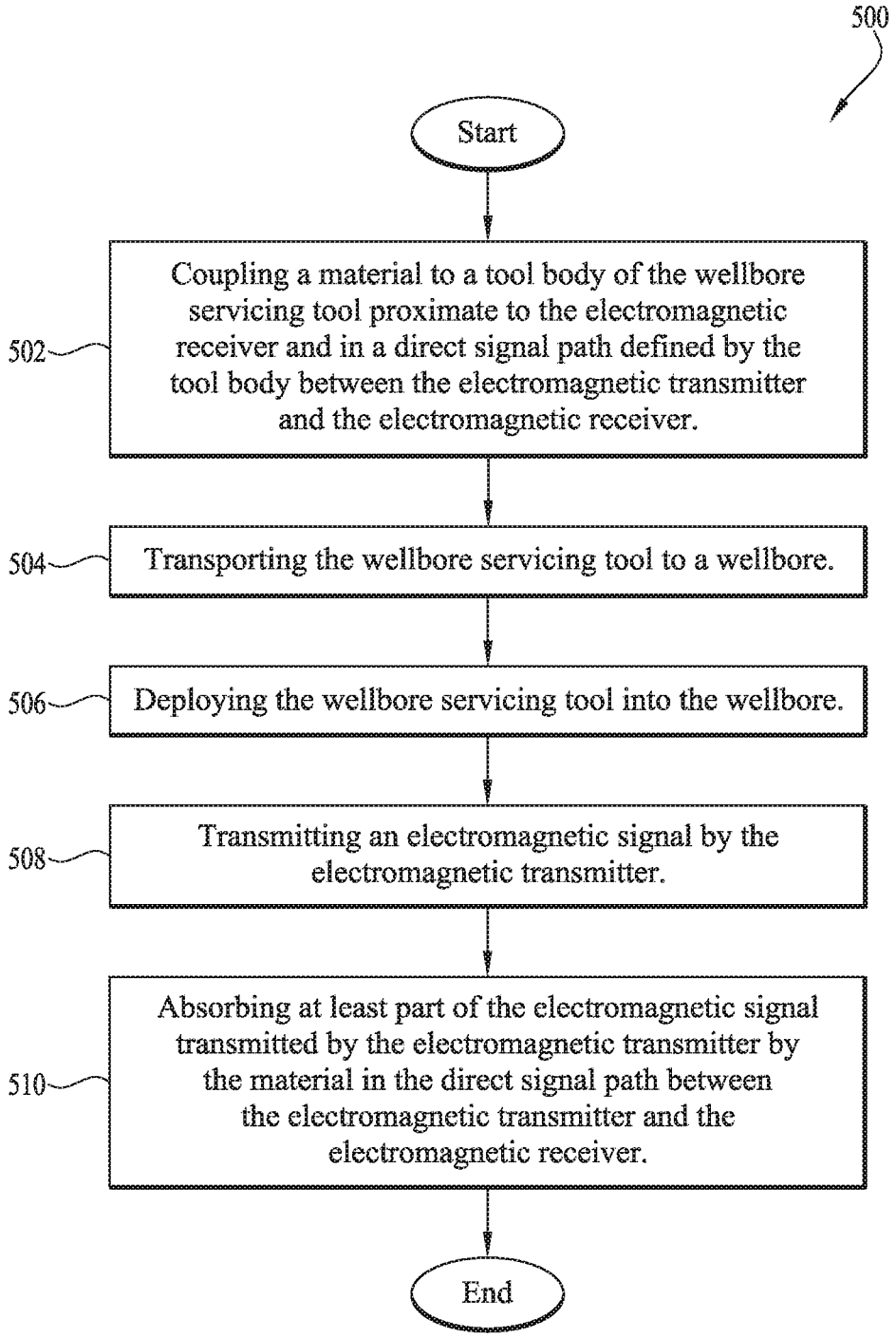
FIG. 5 is a flow chart of a method according to an embodiment of the disclosure.

Turning now to FIG. 5, a method 500 is described. In an embodiment, the method 500 is a method of absorbing a direct signal between an electromagnetic transmitter and an electromagnetic receiver of a wellbore servicing tool. In an embodiment, the wellbore servicing tool is a logging tool. At block 502, the method 500 comprises coupling a material to a tool body of the wellbore servicing tool proximate to the receiver and in a direct signal path defined by the tool body between the transmitter and the receiver. The material may be referred to as absorbing material. In an embodiment, the material is metamaterial. In an embodiment, the material has a negative electro-magnetic index. A material having a negative electro-magnetic index may exhibit (1) an effective electric permittivity less than 0.0 and an effective magnetic permeability greater than 0.0, (2) an effective electric permittivity greater than 0.0 and an effective magnetic permeability less than 0.0, or (3) an effective electric permittivity of less than 0.0 and an effective magnetic permeability of less than 0.0.

In an embodiment, the material coupled to the tool body has an effective electric permittivity of greater than 0.0 and an effective magnetic permeability of greater than 0.0 at a frequency of interest. In an embodiment, the material coupled to the tool body has an effective electric permittivity of greater than 0.0 and an effective magnetic permeability greater than 0.0 and less than 1.0 at a frequency of interest. In an embodiment, the material coupled to the tool body has an effective electric permittivity of greater than 0.0 and an effective magnetic permeability of less than 0.0 at a frequency of interest. In an embodiment, the material coupled to the tool body has an effective electric permittivity of greater than 0.0 and an effective magnetic permeability of greater than −1.0 and less than 0.0 at a frequency of interest. In an embodiment, the material coupled to the tool body has an effective electric permittivity of less than 0.0 and an effective magnetic permeability of less than 0.0 at a frequency of interest.

At block 504, the method 500 comprises transporting the wellbore servicing tool to a wellbore. At block 506, the method 500 comprises deploying the wellbore servicing tool into the wellbore. At block 508, the method 500 comprises transmitting a signal by the transmitter, for example transmitting an electromagnetic signal.

At block 510, the method 500 comprises absorbing at least part of the signal transmitted by the transmitter by the material in the direct signal path between the transmitter and the receiver. The processing of method 500 may further comprise receiving a signal or signals reflected off of one or more subterranean formations or subterranean layers by the receiver of the wellbore servicing tool, for example receiving a reflected electromagnetic signal or reflected electromagnetic signals. The processing of method 500 may further comprise transmitting a data representation of the received signal or signals by the receiver to a data storage unit at the surface proximate to the wellbore or to a data analysis station at the surface proximate to the wellbore. The data representation may be analyzed at the surface to infer structures in the subterranean formations or subterranean layers proximate to the wellbore servicing tool. The data representation may be analyzed at the surface to adapt a trajectory of a drill bit coupled to a tool string that includes the wellbore servicing tool, for example pursuant to logging while drilling activities.

In an embodiment, the method 200 further comprises coupling a signal reception enhancing material to the tool body proximate to the receiver. In an embodiment, the signal reception enhancing material is located between the absorbing material and the receiver. In an embodiment, the signal reception enhancing material is located between the receiver and a toolstring downhole of the wellbore servicing tool (e.g., with the receiver between the transmitter of the wellbore servicing tool and the signal reception enhancing material). In an embodiment, the signal reception enhancing material comprises first signal reception enhancing material located between the receiver and the transmitter and second signal reception enhancing material located between the receiver and the toolstring downhole of the wellbore servicing tool. In an embodiment, the method 200 further comprises enhancing by the signal reception enhancing material a signal received by the receiver.

Figure 6:
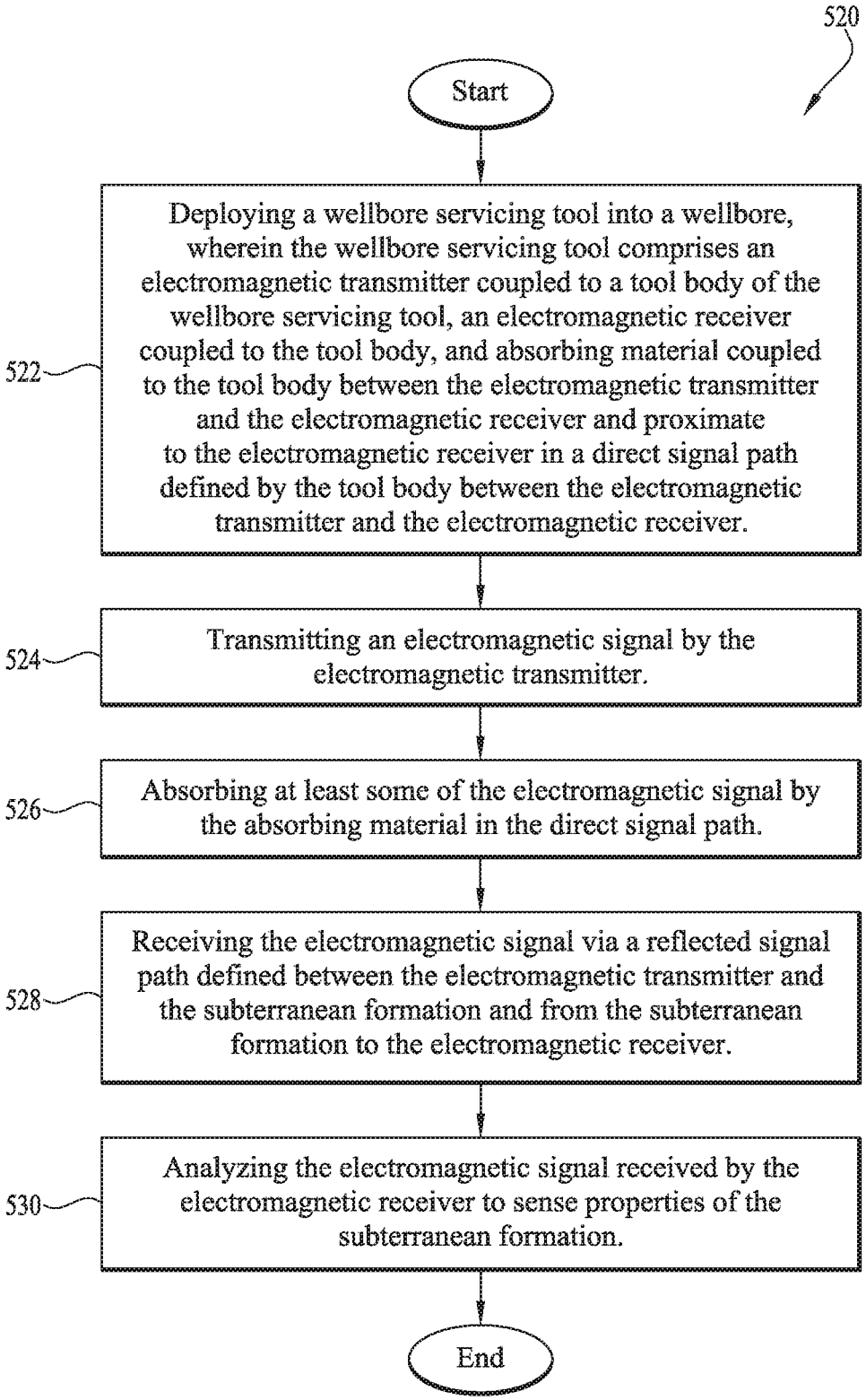
FIG. 6 is a flow chart of another method according to an embodiment of the disclosure.

Turning now to FIG. 6, a method 520 is described. In an embodiment, the method 520 is a method of sensing properties of a subterranean formation proximate to a wellbore. At block 522, the method 520 comprises deploying a wellbore servicing tool into a wellbore, wherein the wellbore servicing tool comprises an electromagnetic transmitter coupled to a tool body of the wellbore servicing tool, an electromagnetic receiver coupled to the tool body, and absorbing material coupled to the tool body between the transmitter and the receiver and proximate to the receiver in a direct signal path defined by the tool body between the transmitter and the receiver.

In an embodiment, the absorbing material exhibits a negative electro-magnetic index. In an embodiment, the absorbing material comprises metamaterial. In an embodiment, the absorbing material is a metamaterial formed as an array of metal rods arranged in a cubical lattice. In an embodiment, the absorbing material exhibits an effective magnetic permeability of less than 0.0 and greater than −1.0. In an embodiment, the absorbing material exhibits an effective electric permittivity of greater than 0.0 and an effective magnetic permeability of less than 0.0. In an embodiment, the absorbing material exhibits an effective electric permittivity of greater than 0.0 and an effective magnetic permeability of greater than 0.0. In an embodiment, the absorbing material exhibits an effective electric permittivity of greater than 0.0 and an effective magnetic permeability of greater than 0.0 and less than 1.0.

At block 524, the method 520 comprises transmitting a signal by the transmitter. At block 526, the method 520 comprises absorbing the signal by the absorbing material in the direct signal path.

At block 528, the method 520 comprises receiving the signal via a reflected signal path defined between the transmitter and the subterranean formation and from the subterranean formation to the receiver. At block 530, the method 520 comprises analyzing the signal received by the receiver to sense properties of the subterranean formation. In an embodiment, the wellbore servicing tool further comprises a metamaterial component coupled to the tool body proximate to the transmitter, and the method 520 further comprises enhancing by the metamaterial component the signal transmitted by the transmitter.

Figure 7:
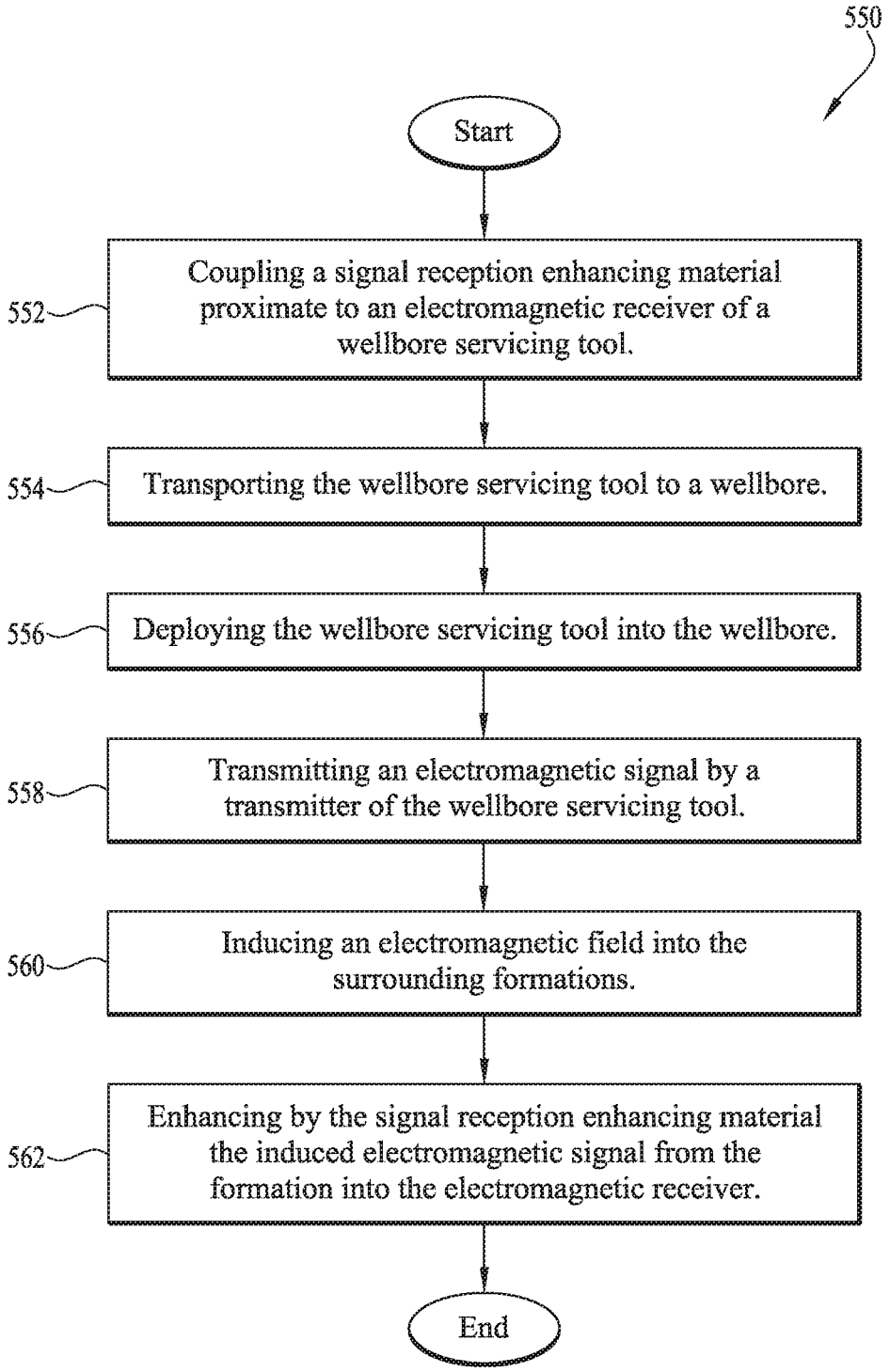
FIG. 7 is a flow chart of yet another method according to an embodiment of the disclosure.

Turning now to FIG. 7, a method 550 is described. In an embodiment, the method 550 is a method of enhancing sensitivity of an electromagnetic receiver of a wellbore servicing tool. At block 552, the method 500 comprises coupling a signal reception enhancing material proximate to an electromagnetic receiver of a wellbore servicing tool. At block 554, the method 550 comprises transporting the wellbore servicing tool to a wellbore. At block 556, the method 550 comprises deploying the wellbore servicing tool into the wellbore. At block 558, the method 550 comprises transmitting an electromagnetic signal by a transmitter of the wellbore servicing tool. At block 560, the method 550 comprises inducing an electromagnetic field into surrounding formations. At block 562, the method 550 comprises enhancing by the signal reception enhancing material the induced electromagnetic signal from the formation into the electromagnetic receiver. In an embodiment, the method 550 may be combined with method 500 or with method 520.

ADDITIONAL DISCLOSURE

The following are non-limiting, specific embodiments in accordance with the present disclosure.

A first embodiment, when is a wellbore servicing tool comprising a tool body, a radio transmitter coupled to the tool body, a receiver coupled to the tool body and spaced apart from the radio transmitter, wherein a portion of the tool body between the radio transmitter and the receiver defines a direct signal path between the radio transmitter and the receiver, and absorbing material coupled to the tool body in the direct signal path between the radio transmitter and the receiver, proximate to the receiver, wherein the absorbing material exhibits a negative electro-magnetic index.

A second embodiment, which is the wellbore serving tool of the first embodiment, wherein the absorbing material exhibits an effective electric permittivity of less than 0.0 and an effective magnetic permeability of greater than 0.0.

A third embodiment, which is the wellbore servicing tool of the second embodiment, wherein the absorbing material exhibits an effective electric permittivity greater than −1.0 and less than 0.0.

A fourth embodiment, which is the wellbore servicing tool of the first embodiment, wherein the absorbing material exhibits an effective electric permittivity of greater than 0.0 and an effective magnetic permeability of less than 0.0.

A fifth embodiment, which is the wellbore servicing tool of the fourth embodiment, wherein the absorbing material exhibits an effective magnetic permeability greater than −1.0 and less than 0.0.

A sixth embodiment, which is the wellbore servicing tool of the first, the second, the third, the fourth, or the fifth embodiment, wherein the wellbore servicing tool is a logging tool.

A seventh embodiment, which is the wellbore servicing tool of the first, the second, the third, the fourth, the fifth, or the sixth embodiment, wherein the radio transmitter transmits signals in the frequency range of 1 kHz to 2 GHz.

An eighth embodiment, which is the wellbore servicing tool of the first, the second, the third, the fourth, the fifth, or the sixth embodiment, wherein the radio transmitter transmits signals in the frequency range of about 200 kHz to about 2 MHz A ninth embodiment, which is a method of absorbing a direct signal between a radio transmitter and receiver of a wellbore servicing tool comprising coupling a material having a negative electro-magnetic index to a tool body of the wellbore servicing tool proximate to the receiver and in a direct signal path defined by the tool body between the radio transmitter and the receiver, transporting the wellbore servicing tool to a wellbore, deploying the wellbore servicing tool into the wellbore, transmitting a signal by the radio transmitter, and absorbing the signal transmitted by the radio transmitter by the material having the negative electromagnetic index in the direct signal path between the radio transmitter and the receiver.

A tenth embodiment, which is the method of the ninth embodiment, wherein the material having the negative electro-magnetic index has an effective electric permittivity of less than 0.0 and an effective magnetic permeability of greater than 0.0.

An eleventh embodiment, which is the method of the tenth embodiment, wherein the material has an effective electric permittivity greater than −1.0 and less than 0.0.

A twelfth embodiment, which is the method of the ninth embodiment, wherein the material having the negative electro-magnetic index has an effective electric permittivity of greater than 0.0 and an effective magnetic permeability of less than 0.0.

A thirteenth embodiment, which is the method of the twelfth embodiment, wherein the material has an effective magnetic permeability greater than −1.0 and less than 0.0.

A fourteenth embodiment, which is the method of the ninth, the tenth, the eleventh, the twelfth, or the thirteenth embodiment, wherein the material having a negative electromagnetic index is a metamaterial.

A fifteenth embodiment, which is a method of sensing properties of a subterranean formation proximate to a wellbore comprising deploying a wellbore servicing tool into a wellbore, wherein the wellbore servicing tool comprises an electromagnetic transmitter coupled to a tool body of the wellbore servicing tool, an electromagnetic receiver coupled to the tool body, and absorbing material coupled to the tool body between the electromagnetic transmitter and the electromagnetic receiver and proximate to the electromagnetic receiver in a direct signal path defined by the tool body between the electromagnetic transmitter and the electromagnetic receiver, transmitting an electromagnetic signal by the electromagnetic transmitter, absorbing at least some of the electromagnetic signal by the absorbing material in the direct signal path, receiving the electromagnetic signal via a reflected signal path defined between the electromagnetic transmitter and the subterranean formation and from the subterranean formation to the electromagnetic receiver, and analyzing the electromagnetic signal received by the electromagnetic receiver to sense properties of the subterranean formation.

A sixteenth embodiment, which is the method of the fifteenth embodiment, wherein the absorbing material exhibits a negative electro-magnetic index.

A seventeenth embodiment, which is the method of the sixteenth embodiment, wherein the absorbing material exhibits an effective electric permittivity of less than 0.0 and an effective magnetic permeability of greater than 0.0.

An eighteenth embodiment, which is the method of the sixteenth embodiment, wherein the absorbing material exhibits an effective electric permittivity of greater than 0.0 and an effective magnetic permeability of less than 0.0.

A nineteenth embodiment, which is the method of the fifteenth embodiment, wherein the absorbing material exhibits an effective electric permittivity of less than 0.0 and an effective magnetic permeability of less than 0.0.

A twentieth embodiment, which is the method of the sixteenth embodiment, wherein the absorbing material is a metamaterial formed as an array of metal rods arranged in a cubical lattice.

A twenty-first embodiment, which is the method of the fifteenth, the sixteenth, the seventeenth, the nineteenth embodiment, or the twentieth embodiment, wherein the absorbing material exhibits an effective magnetic permeability of less than 0.0 and greater than −1.0.

A twenty-second embodiment, which is the method of the fifteenth embodiment or the twentieth embodiment, wherein the absorbing material exhibits an effective electric permittivity of greater than 0.0 and an effective magnetic permeability of greater than 0.0.

A twenty-third embodiment, which is a wellbore servicing tool comprising a tool body, an electromagnetic transmitter coupled to the tool body, an electromagnetic receiver coupled to the tool body and spaced apart from the electromagnetic transmitter, wherein a portion of the tool body between the electromagnetic transmitter and the electromagnetic receiver defines a direct signal path between the electromagnetic transmitter and the electromagnetic receiver, and an absorbing material coupled to the tool body in the direct signal path between the electromagnetic transmitter and the electromagnetic receiver.

A twenty-fourth embodiment, which is the wellbore servicing tool of the twenty-third embodiment, wherein the absorbing material exhibits an effective electric permittivity of greater than 0.0 and an effective magnetic permeability of greater than 0.0.

A twenty-fifth embodiment, which is the wellbore servicing tool of the twenty-third embodiment, wherein the absorbing material exhibits an effective magnetic permeability greater than 0.0 and less than 1.0

A twenty-fifth embodiment, which is the wellbore servicing tool of the twenty-third or the twenty-fourth embodiment, wherein the absorbing material exhibits an effective electric permittivity of greater than 0.0 and an effective magnetic permeability of less than 0.0.

A twenty-sixth embodiment, which is the wellbore servicing tool of the twenty-third or twenty-fifth embodiment, wherein the absorbing material exhibits an effective magnetic permeability greater than −1.0 and less than 0.0.

A twenty-seventh embodiment, which is the wellbore servicing tool of the twenty-third, twenty-fourth, twenty-fifth, or twenty-sixth embodiment, wherein the wellbore servicing tool is a logging tool.

A twenty-eighth embodiment, which is the wellbore servicing tool of the twenty-third, twenty-fourth, twenty-fifth, twenty-sixth, or twenty-seventh embodiment, wherein the electromagnetic transmitter transmits signals in the frequency range of 1 kHz to 2 GHz.

A twenty-ninth embodiment, which is the wellbore servicing tool of the twenty-third, twenty-fourth, twenty-fifth, twenty-sixth, or twenty-seventh embodiment, further comprising a signal reception enhancing material coupled to the tool body and located proximate to the electromagnetic receiver.

A thirtieth embodiment, which is a method of absorbing a direct signal between an electromagnetic transmitter and an electromagnetic receiver of a wellbore servicing tool coupling a material to a tool body of the wellbore servicing tool proximate to the electromagnetic receiver and in a direct signal path defined by the tool body between the electromagnetic transmitter and the electromagnetic receiver, transporting the wellbore servicing tool to a wellbore, deploying the wellbore servicing tool into the wellbore, transmitting an electromagnetic signal by the electromagnetic transmitter, and absorbing at least a part of the electromagnetic signal transmitted by the electromagnetic transmitter by the material in the direct signal path between the electromagnetic transmitter and the electromagnetic receiver.

A thirty-first embodiment, which is the method of the thirtieth embodiment, wherein the material has an effective electric permittivity of greater than 0.0 and an effective magnetic permeability of greater than 0.0.

A thirty-second embodiment, which is the method of the thirty-first embodiment, wherein the material has an effective magnetic permeability greater than 0.0 and less than 1.0.

A thirty-third embodiment, which is the method of the thirtieth embodiment, wherein the material has an effective electric permittivity of greater than 0.0 and an effective magnetic permeability of less than 0.0.

A thirty-fourth embodiment, which is the method of the thirty-third embodiment, wherein the material has an effective magnetic permeability greater than −1.0 and less than 0.0.

A thirty-fifth embodiment, which is the method of the thirtieth, the thirty-first, the thirty-second, the thirty-third, or the thirty-fourth embodiment, wherein the material is a metamaterial.

A thirty-fifth embodiment, which is the wellbore serving tool of the first, second, third, fourth, fifth, sixth, seventh, eighth, twenty-third, twenty-fourth, twenty-fifth, twenty-sixth, twenty-seventh, twenty-eighth, or twenty-ninth embodiment, further comprising a metamaterial component coupled to the tool body between the electromagnetic transmitter and the receiver, wherein the absorbing material is located proximate to the receiver and the metamaterial component is located proximate to the electromagnetic transmitter.

A thirty-sixth embodiment, which is the method of the ninth, tenth, eleventh, twelfth, thirteenth, fourteenth, thirtieth, thirty-first, thirty-second, thirty-third, thirty-fourth, or thirty-fifth embodiment, wherein the material proximate to the receiver is a metamaterial, further comprising coupling a metamaterial component to the tool body between the electromagnetic transmitter and the receiver proximate to the electromagnetic transmitter and enhancing by the metamaterial component the signal transmitted by the electromagnetic transmitter.

A thirty-seventh embodiment, which is the method of the fifteenth, sixteenth, seventeenth, eighteenth, nineteenth, twentieth, twenty-first, or twenty-second embodiment, wherein the wellbore servicing tool further comprises a metamaterial component coupled to the tool body proximate to the electromagnetic transmitter, further comprising enhancing by the metamaterial component the signal transmitted by the electromagnetic transmitter.

A thirty-eighth embodiment, which is the method of the twenty-second embodiment, wherein the absorbing material exhibits an effective permeability of greater than 0.0 and less than 1.0.

A thirty-ninth embodiment, which is the method of enhancing sensitivity of an electromagnetic receiver of a wellbore servicing tool, comprising coupling a signal reception enhancing material proximate to an electromagnetic receiver of a wellbore servicing tool, transporting the wellbore servicing tool to a wellbore, deploying the wellbore servicing tool into the wellbore, transmitting an electromagnetic signal by a transmitter of the wellbore servicing tool, inducing an electromagnetic field into surrounding formations; and enhancing by the signal reception enhancing material the induced electromagnetic signal from the formation into the electromagnetic receiver.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A wellbore servicing tool, comprising:

a tool body;

an electromagnetic transmitter coupled to the tool body, wherein the electromagnetic transmitter is configured to transmit electromagnetic signals in the frequency range 200 kHz to 2 MHz with a duty cycle of 25% to 50%;

an electromagnetic receiver coupled to the tool body and spaced apart from the electromagnetic transmitter, wherein the electromagnetic receiver comprises a receiving antenna and wherein a portion of the tool body between the electromagnetic transmitter and the electromagnetic receiver defines a direct signal path between the electromagnetic transmitter and the electromagnetic receiver;

absorbing material coupled to the tool body in the direct signal path between the electromagnetic transmitter and the electromagnetic receiver, wherein the absorbing material is a first metamaterial formed as a fabric of metal wires or metal rods interconnected with each other and arranged in a cubical lattice;

a first signal reception enhancing material coupled to an outside of the tool body between the absorbing material and the electromagnetic receiver, uphole of the electromagnetic receiver, wherein the first signal reception enhancing material is a second metamaterial that is different from the first metamaterial; and a second signal reception enhancing material coupled to an outside of the tool body downhole of the electromagnetic receiver, wherein the second signal reception enhancing material is the second metamaterial.

2. The wellbore servicing tool of claim 1, wherein the absorbing material exhibits an effective electric permittivity of greater than 0.0 and an effective magnetic permeability greater than 0.0 and less than 1.0.

3. The wellbore servicing tool of claim 1, wherein the absorbing material exhibits an effective electric permittivity greater than 0.0 and an effective magnetic permeability greater than −1.0 and less than 0.0.

4. The wellbore servicing tool of claim 1, wherein the wellbore servicing tool is a logging tool.

5. The wellbore servicing tool of claim 1, wherein the electromagnetic transmitter is configured to transmit electromagnetic signals in the frequency range of 1 MHz+/−1 kHz.

6. The wellbore servicing tool of claim 1, further comprising centralizers coupled to the tool body.

7. The wellbore servicing tool of claim 1, wherein the electromagnetic transmitter is configured to transmit electromagnetic signals by sweeping the electromagnetic signals through a range of frequencies from 200 kHz to 2 MHz.

8. The wellbore servicing tool of claim 1, wherein the first metamaterial exhibits a first electric permittivity and a first magnetic permeability and the second material exhibits a second electric permittivity and a second magnetic permeability, wherein either (1) the first electric permittivity is different from the second electric permittivity, (2) the first magnetic permeability is different from the second magnetic permeability, or (3) both the first electric permittivity is different from the second electric permittivity and the first magnetic permeability is different from the second magnetic permeability.

9. The wellbore servicing tool of claim 1, wherein the second material exhibits an effective electric permittivity of greater than 0.0 and an effective magnetic permeability of less than −1.0.

10. A method of absorbing a direct signal between an electromagnetic transmitter and an electromagnetic receiver of a wellbore servicing tool, comprising:

coupling an absorbing material to an outside of a tool body of the wellbore servicing tool proximate to the electromagnetic receiver and in a direct signal path defined by the tool body between the electromagnetic transmitter and the electromagnetic receiver, wherein the absorbing material is a first metamaterial formed as a fabric of metal wires or metal rods interconnected with each other and arranged in a cubical lattice;

coupling a first signal reception enhancing material to an outside of the tool body between the absorbing material and the electromagnetic receiver, wherein the first signal enhancing material is a second metamaterial that is different from the first metamaterial;

coupling a second signal reception enhancing material to an outside of the tool body downhole of the electromagnetic receiver, wherein the second signal enhancing material is the second metamaterial;

transporting the wellbore servicing tool to a wellbore;

deploying the wellbore servicing tool into the wellbore;

protecting the material coupled to the outside of the tool body by the protective sheath from contact with the wellbore during deployment of the wellbore servicing tool into the wellbore;

transmitting an electromagnetic signal in a frequency range of 200 kHz to 2 MHz with a duty cycle of 25% to 50% by the electromagnetic transmitter;

absorbing at least part of the electromagnetic signal transmitted by the electromagnetic transmitter by the absorbing material coupled to the outside of the tool body in the direct signal path between the electromagnetic transmitter and the electromagnetic receiver; and enhancing a signal received by the electromagnetic receiver by the first signal reception enhancing material and by the second signal reception enhancing material.

11. The method of claim 10, wherein the absorbing material has an effective electric permittivity of greater than 0.0 and an effective magnetic permeability of greater than 0.0.

12. The method of claim 11, wherein the absorbing material has an effective magnetic permeability greater than 0.0 and less than 1.0.

13. The method of claim 10, wherein the absorbing material has an effective electric permittivity of greater than 0.0 and an effective magnetic permeability of less than 0.0.

14. The method of claim 13, wherein the absorbing material has an effective magnetic permeability greater than −1.0 and less than 0.0.

15. The method of claim 10, wherein transmitting the electromagnetic signal in the frequency range 200 kHz to 2 MHz comprises sweeping the electromagnetic signal through a range of frequencies from 200 kHz to 2 MHz.

* * * * *